US007674369B2

(12) United States Patent
Abulnaga et al.

(10) Patent No.: US 7,674,369 B2
(45) Date of Patent: Mar. 9, 2010

(54) PROCESS FOR RECOVERING ULTRAFINE SOLIDS FROM A HYDROCARBON LIQUID

(75) Inventors: Baha E. Abulnaga, Hercules, CA (US); Jose Guitian, Madrid (ES); Sara Ouzts Lindsay, Emeryville, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 337 days.

(21) Appl. No.: 11/618,244

(22) Filed: Dec. 29, 2006

(65) Prior Publication Data

US 2008/0156700 A1 Jul. 3, 2008

(51) Int. Cl.
*C10G 31/10* (2006.01)

(52) U.S. Cl. ..... 208/161; 208/146; 208/153; 208/155; 208/157; 210/512.1; 210/512.2; 210/767; 210/768; 210/770

(58) Field of Classification Search ..... 208/153, 208/161, 177, 251 R, 146, 155, 157; 210/512.1, 210/512.2, 767–768, 770; 202/86, 88, 90, 202/96, 99–100, 208; 201/7, 25, 29
See application file for complete search history.

(56) References Cited

U.S. PATENT DOCUMENTS 2,313,940 A 3/1943 Hirsch et al.
2,521,757 A 9/1950 Smith
4,013,516 A * 3/1977 Greenfield et al. ..... 201/2.5
4,040,958 A 8/1977 Rammler
4,411,874 A 10/1983 Lee
4,557,821 A 12/1985 Lopez et al.
4,710,486 A 12/1987 Lopez et al.
4,732,664 A 3/1988 Martini et al.
4,762,812 A * 8/1988 Lopez et al. ..... 502/26
4,778,605 A 10/1988 Anthoney et al.
4,824,821 A 4/1989 Lopez et al.
4,857,496 A 8/1989 Lopez et al.
4,952,306 A * 8/1990 Sawyer et al. ..... 208/216 R
4,970,190 A 11/1990 Lopez et al.
5,008,001 A * 4/1991 Kitamura et al. ..... 208/143
5,094,991 A 3/1992 Lopez et al.
5,162,282 A 11/1992 Lopez et al.
5,164,075 A 11/1992 Lopez
5,178,749 A 1/1993 Lopez et al.
5,294,329 A 3/1994 Kramer
5,298,152 A 3/1994 Kramer
5,420,088 A 5/1995 Silva et al.
5,424,263 A 6/1995 Buehler
5,484,755 A 1/1996 Lopez
5,935,418 A 8/1999 Chakrabarty et al.
6,187,172 B1 * 2/2001 Plummer ..... 208/44
6,511,937 B1 1/2003 Bearden et al.
6,974,842 B1 12/2005 Spena et al.
2003/0098262 A1 5/2003 Rendall
2006/0166809 A1 * 7/2006 Malek et al. ..... 502/20
2006/0272982 A1 12/2006 Montanari et al.

* cited by examiner

*Primary Examiner*—Glenn A Caldarola
*Assistant Examiner*—Brian McCaig
(74) *Attorney, Agent, or Firm*—Steven R. Ellinwood

(57) ABSTRACT

A method for separating and recovering ultrafine particulate solid material from a suspension or slurry of the solid material and a hydrocarbon liquid by precipitation or flocculation of a heavy fraction of the hydrocarbon liquid with an effective amount of a precipitation or flocculation agent such that the precipitated heavy fraction encapsulates the particulate solid material. The method further comprises coking the precipitated heavy fraction and grinding the coked product to an ultrafine size.

34 Claims, 1 Drawing Sheet

PROCESS FOR RECOVERING ULTRAFINE SOLIDS FROM A HYDROCARBON LIQUID

FIELD OF THE INVENTION

The present invention is directed to a process for separating ultrafine hydrocracking catalyst solids from a petroleum hydrocarbon liquid slurry containing said solids.

BACKGROUND OF THE INVENTION

Catalysts have been used widely in the refining and chemical processing industries for many years. Hydroprocessing catalysts, including hydrotreating and hydrocracking catalysts, are now widely employed in facilities worldwide. These hydroprocessing catalysts typically produce increased yields, faster reaction times, and improved product properties when compared with prior (non-catalytic thermal) processes for converting crude oils into refined products.

Hydroprocessing catalysts typically employed in commercial application today are classified as "supported" catalysts. These catalyst supports, which are generally molecular sieves such as SAPO's or zeolites, are often composed of materials such as silica, alumina, zirconia, clay, or some hybrid of these. A more expensive material, which imparts much of the actual catalytic activity, is impregnated on the support. These catalytic materials typically include metals such as nickel, molybdenum, and cobalt. In some cases platinum, palladium, and tungsten may be used.

Recently, a new generation of hydroprocessing catalysts has emerged. These catalysts do not require a support material. The catalyst is instead comprised of unsupported, micron-sized catalyst particles, such as molybdenum sulfide or nickel sulfide. These catalysts, due to factors such as increased surface area and other factors not discussed here, are many times more active than traditional supported catalysts. Performance is greatly improved during conversion operations when compared to traditional supported catalysts. One area in which these highly active, unsupported catalysts are currently being employed is vacuum residuum hydrocracking. In the process of being utilized in residue hydrocracking service, these unsupported catalysts often suffer a high amount of metals (specifically vanadium) and coke deposition, which increases the need for fresh makeup catalyst.

One drawback to both supported and unsupported catalysts is their cost. Typically, replacement costs for an expensive noble metal catalyst may be a major operating expenditure item in a refinery or chemical plant. A market has thus emerged to reclaim spent catalysts, and specifically spent hydroprocessing catalysts, so that the valuable metals can be recycled. The current high price of various metals has driven this need even further. Several spent catalyst reclaimers are currently in business at various locations around the world. Unfortunately, however, these roasting (or pyrometallurgical) based reclaimers are designed to recover metals from supported catalysts.

Due to the high concentrations of valuable metals, specifically molybdenum and nickel, used in this new generation of unsupported catalysts, a need has been identified for an economical unsupported catalyst metals recovery process which depends upon a feedstock of spent catalyst free of oil for the greatest efficiency in catalyst recovery. Co-pending patent application, Ser. No. 11/192,522 discloses a novel process for the removal of metals from an unsupported spent catalyst. In this method the unsupported spent catalyst is subject to leaching reactions. Vanadium is removed as a precipitate, while a solution comprising molybdenum and nickel is subjected to further extraction steps for the removal of these metals. In this process it is important to provide an oil free recovered catalyst as a starting material for metals recovery and catalyst regeneration. The present invention addresses this need and provides a novel and economical method for removal of all hydrocarbon liquid materials from spent hydrocracking catalysts as a preliminary step to recovery of metals from the spent catalyst. Accordingly, the present invention is generally directed to a novel method for separating and recovering ultrafine particulate solid material from a suspension of the solid material and a hydrocarbon liquid comprising: (i) precipitation or flocculation of a heavy fraction of the hydrocarbon liquid such that the precipitated heavy fraction encapsulates the particulate solid material, (ii) separating the heavy fraction from the light fraction by centrifugation and, (iii) coking the precipitated combination to remove essentially all liquid hydrocarbon materials from the solid material to provide a dry solid material suitable for metals recovery and catalyst regeneration processes.

Various methods for separating fine catalyst solids from hydrocarbon liquids resulting from hydroconversion processes are known in the art. For example, U.S. Pat. No. 5,008,001 to Kitamura et al. discloses a method for separating catalyst solids from heavy oil that, in one embodiment, consists of centrifuging the oil and catalyst slurry and heat drying the resulting catalyst cake at temperatures and/or retention times limited so as to prevent or minimize coking of the remaining heavy oil. In another example, U.S. Pat. No. 6,511,937 to Bearden et al. discloses a method for recovering deasphalted oil and solvent deasphalted rock from a slurry hydroprocessing system and calcining the deasphalted rock at an extremely high temperature of about 1200° F. to produce an ash catalyst precursor which is recycled back to the slurry hydroprocessing system. In yet another example, U.S. Pat. No. 6,974,824 to Spena et al., discloses a system and method for recovering a catalyst from a slurry comprising the catalyst and residual hydrocarbons by heating the slurry to vaporize the hydrocarbons in a heater preferably designed to prevent coking. In a final example, U.S. Pat. No. 4,732,664 to Martini discloses a method for separating finely divided solid particles from a hydroprocessing liquid comprising precipitating asphaltenes from the hydroprocessing liquids whereby the precipitation process promotes the agglomeration of the solid particles and removing the agglomerated particles from the liquid by centrifugation. Drying of the solid product obtained from the centrifuge underflow is mentioned as a method for removal of the remaining hydrocarbon liquids.

It is an object of the present invention to improve upon the above disclosed methods of separating catalyst particles from a hydrocarbon liquid slurry thereof, which invention is further described below.

SUMMARY OF THE INVENTION

The present invention is generally directed to a method for separating and recovering ultrafine particulate solid material from a suspension of the solid material and a hydrocarbon liquid by precipitation or flocculation of a heavy fraction of the hydrocarbon liquid with an effective amount of a precipitation or flocculation agent such that the precipitated heavy fraction encapsulates the particulate solid material. The encapsulated particulate solid material is then separated from the remaining light fraction of the hydrocarbon liquid and precipitation agent, dried at high temperature to form coke and prepared for further processing to separate the particulate solid material from the heavy coked fraction and recover valuable metals for synthesis of new catalyst.

More particularly, but not by way of limitation, the present invention is directed to a process useful for separating an ultrafine particulate solid material comprising a spent, or partially spent, micron or submicron sized catalyst from a hydrocarbonaceous oil which is taken as a bleed slurry from a hydroprocessing or hydrocracking reactor. The process of the present invention is a preliminary step to a process for recovering metals from the catalyst and has the advantage over conventional oil/solid separation processes in that it provides a coked catalyst solid that is free of liquid hydrocarbon contamination, which improves the efficacy of methods for recovering valuable metals and synthesizing fresh catalyst.

Accordingly, the present invention is directed to a process for separating a solid material from a hydrocarbon liquid comprising the following steps:

a) obtaining a bleed slurry comprising the hydrocarbon liquid and the solid material,
b) cooling the bleed slurry,
c) mixing the bleed slurry with a flocculant and to form a first mixture comprising the hydrocarbon liquid, a first solvent and a flocculent containing the solid material,
d) separating the first mixture in a first centrifuge to form a second mixture and a third mixture, wherein the second mixture contains a low concentration of the flocculent and the third mixture contains a high concentration of the flocculent,
e) separating the second mixture in at least one second centrifuge to form a fourth mixture comprising the first solvent and the hydrocarbon liquid and a fifth mixture containing a high concentration of the flocculent,
f) combining the third mixture and the fifth mixture in a feed tank to form a final mixture comprising a high concentration of the flocculent, a low concentration of the first solvent and a low concentration of the hydrocarbon liquid,
g) drying the final mixture in a drying device to form a hydrocarbon vapor mixture and a coked material wherein the hydrocarbon vapor comprises the first solvent, a light fraction of the hydrocarbon liquid and entrained amounts of the solid material and wherein the coked material comprises the solid material and a heavy fraction of the hydrocarbon liquid,
h) recovering the hydrocarbon vapor mixture from the drying device and separating the entrained amounts of the solid material, the solvent and the light fraction of the hydrocarbon liquid by means of a system of one or more condensers and one or more oil recovery columns,
i) recovering the coked material from the drying device.

DETAILED DESCRIPTION OF THE INVENTION

Figure 1:
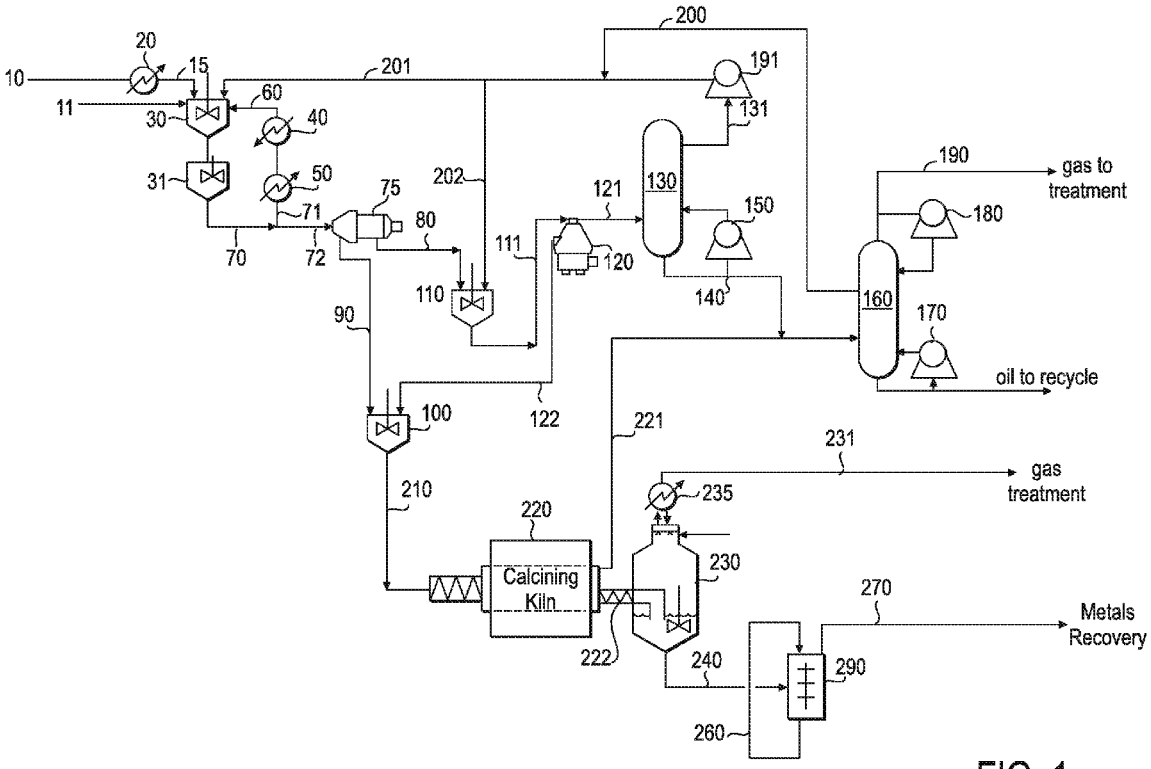
FIG. 1 depicts a schematic diagram of a preferred embodiment of a system for carrying out the method for separating ultrafine particulate solid material from a hydrocarbon liquid as disclosed herein.

A novel process has been discovered that enables the economic recovery of catalyst solids, which may be entirely spent catalyst or a mixture of active catalyst and spent catalyst, from a hydrocracking reactor bleed slurry as a preparatory step to metals recovery and catalyst regeneration/synthesis. The claimed process comprises the steps of precipitating a heavy hydrocarbon fraction together with catalyst solids from the bleed slurry with a flocculating agent, such as a solvent (also referred to as a flocculant), to form a heavy hydrocarbon flocculent which encapsulates the catalyst solids (also referred to as a flocculent), separating the precipitated heavy hydrocarbon/catalyst solid flocculent from the hydrocarbon liquid and drying the heavy hydrocarbon/catalyst solid complex under coking conditions to provide a solid material that is hydrocarbon liquid free and that can be readily prepared for metals recovery and catalyst regeneration operations.

Referring to FIG. 1 a bleed slurry containing hydrocarbon liquids and spent catalyst is fed by line 10 to a heat exchanger 20 and then by line 15 to at least one mixing tank 30, 31 wherein the bleed slurry is mixed with a flocculating agent, such as a solvent suitable for asphaltene precipitation, which is fed to mixing tank 30. Fresh solvent is fed to mixing tank 30 via line 11 and recycled solvent is fed to mixing tank 30 via line 201. Suitable asphaltene precipitation solvents include, without limitation, naphtha, heavy naphtha, light naphtha, hexane, heptane and commercially available solvents such as ShelSol™ 100 series solvents. The bleed slurry contains a mass concentration of catalyst solids ranging from 5% to 40% catalyst solids, preferably 15% to 30% catalyst solids, most preferably about 20% to 30% catalyst solids. A major portion of the catalyst solids will be spent catalyst and a minor portion will be activated catalyst, however, preferably all of the catalyst in the bleed slurry will be spent catalyst. Further, all of the catalyst solids recovered in the bleed slurry are unsupported catalysts. The particle diameter of the catalyst solids contained in the bleed slurry will be 100 μm or less, preferably about 40 μm to 80 μm and most preferably 0.01 μm to 40 μm. It is an important aspect of this invention that the bleed slurry contains at least 2.5 weight percent asphaltenes. Any bleed slurry containing less than this amount of asphaltenes can be mixed with any asphaltene rich additive, such as a vacuum residuum, heavy crude oil, refractory heavy distillates, decanted oils from a fluid catalytic cracking (FCC) process and lubricating oils. The bleed slurry is retained in the cooling apparatus 20 far a period of time sufficient to cool the slurry to about 65° C. The cooled bleed slurry is then fed via line 15 to one or more mixing tanks 30, 31 and mixed with the selected asphaltene precipitation solvent at a solvent to slurry mass ratio between about 3:1 to 1:3, preferably 2:1 to 1:2 and most preferably 1:1 frat least 20 minutes. The most effective solvent to the mass ratio to use can be readily determined by one skilled in the art and will depend upon various factors including, for example, the asphaltene content of the slurry, the particular solvent to be used and the degree of solids recovery that is desired. The temperature of the bleed slurry/solvent mixture is maintained at approximately 65° C. for a period of time sufficient to promote substantial asphaltene precipitation, although this temperature may range from about 55° C. to about 75°. The temperature of the mixture is maintained by cycling the mixture through a temperature maintenance loop comprising line 70, line 71, cooling apparatuses 50, heating apparatus 40 and line 60. The period of time necessary to promote substantial asphaltene precipitation of the mixture will vary depending upon the asphaltene content of the mixture, the solvent selected and the temperature of the mixture, but will normally be in a range of 15 minutes to one hour, preferably about 15 minutes to 30 minutes and most preferably about at least 20 minutes.

When precipitation of most or all of the asphaltene in the mixture is complete the mixture is fed via line 72 to the first stage centrifuge 75 which is operated at about 2000 to 3500 G (where G is gravity acceleration=9.8 m/sec$^2$), preferably at about 2500 to 3000 G to separate the mixture into two phases; phase 1, herein termed the overflow, containing the hydrocarbon liquid and from 10% to 30% by weight of the original solids fed to the centrifuge and phase 2, herein termed the underflow, containing primarily (about 70% to 90% by weight of the total quantity of solids fed to the centrifuge) precipitated asphaltenes encapsulating catalyst solids and about 40% by weight hydrocarbon liquid and solvent. The overflow phase is fed via line 80 to a heated mixing tank 110, diluted with additional solvent in said mixing tank if the solids content exceeds about 5%, then fed via line 111 to a second centrifuge 120 which is typically operated at about 9000 G. The overflow from said second centrifuge is fed by a line 121 to a conventional solvent recovery condenser 130 and oil recovery condenser 160. Any solids recovered in the solid recovery stage are fed by a line 131 and pump 191 back to the initial bleed slurry mixing tanks 30, 31 via line 201 or, optionally, the second stage mixing tank 110 via line 202. Recovered solvent is recycled to mixing tank 30 via line 201. The underflow from said second centrifuge is fed via line 122 and combined with the underflow from the first stage centrifuge in feed tank 100.

Underflow from the first stage centrifuge is fed via line 90 to feed tank 100 and combined with underflow from the second stage centrifuge 120. The combined underflow from the first stage centrifuge 75 and the second stage centrifuge 120 is mixed in the feed tank 100 to form a combined slurry mixture then fed via line 210 to drying device 220. The drying device 220 may be any device known to those skilled in the art to be suitable for vaporizing the hydrocarbon liquids contained in a hydrocarbon liquid/solid slurry and coking any heavy hydrocarbon fraction contained in the hydrocarbon liquids. Preferably such a drying device is an indirect fired kiln, an indirect fired rotary kiln, an indirect fired dryer, an indirect fired rotary dryer, a vacuum dryer, a flexicoker or any such drying device with substantially the same capability as the foregoing. The most preferred drying device for purposes of the instant invention is an indirect fired rotary kiln. The combined slurry mixture is heated in the drying device 220 to a suitable calcining temperature between about 350° C. to about 550° C., which temperature is maintained for a sufficient residence time to produce a coked solid material and a hydrocarbon gas stream. The atmosphere in the drying device is inert, which is preferably an oxygen free nitrogen atmosphere but maybe any other inert non-oxidizing atmosphere or under vacuum. Gas from the drying device is recovered and fed via line 221 to oil recovery condenser 160. Any solids entrained in the gas from the kiln are recovered in the oil recovery condenser 160 and recycled via lines 200 and 201 or, optionally, via line 202 to the bleed slurry mixing tanks 30, 31 or mixing tank 110. The coked solid material is fed via suitable means 222, such as an auger, screw conveyor, lock hopper or gravity flow, to a water quenching tank or spraying tank 230 to thermally shock and break-up agglomerations of coked particulate matter and cool the material to a temperature sufficient to form an aqueous coked solids slurry. Hot vapor from the aqueous quench tank is fed through heat exchanger 235 via line 231 to further gas treatment. The aqueous coked solids slurry is fed via line 240 to a grinding mill, preferably a vertical grinding or attrition mill 290, and therein reduced in size to between about 10 μm to 60 μm, preferably to about 10 μm to 40 μm and, most preferably, about 15 to 20 μm in preparation for further metals recovery processes, such as that disclosed in co-pending application Ser. No. 11/192,522. In the process of quenching and grinding the coked catalyst preliminary metals recovery steps may be implemented such as the addition of ammonia to promote metals leaching and pH control. Optionally, if an aqueous slurry of the coked solid materials is not needed, the coked solid materials may be cooled by means of a solids at external cooling system that results in a dry coked solids product.

The process for separation of ultrafine catalyst materials from a hydrocarbon liquid described above is useful in connection with any slurry hydroprocessing system that will benefit from the recovery and recycling of the catalyst materials. In particular, this process is useful in connection with the slurry hydroprocessing systems and catalysts disclosed in the following United States patents the disclosures of each of which are incorporated herein by reference: U.S. Pat. Nos. 4,557,821; 4,710,486, 4,762,812; 4,824,821; 4,857,496; 4,970,190; 5,094,991; 5,162,282; 5,164,075; 5,178,749; 5,294,329; 5,298,152 and 5,484,755. The following example illustrates one method for removing spent catalyst solids from a hydrocarbon liquid slurry containing the same, but should not be construed to limit the many means and methods by which the processes of this invention may be practiced.

EXAMPLE

To demonstrate this invention laboratory bench scale testing of various hydrocarbonaceous fluids was conducted to determine the minimum asphaltene content desirable to effect successful precipitation or flocculation of asphaltene (flocculent) when exposed to a flocculation agent (flocculant) such as heptane or naphtha. These tests indicated that a minimum threshold of 2.5 weight % (wt %) asphaltene content is preferable for successful flocculation of micron sized particulate matter suspended in the hydrocarbonaceous fluids, such as a slurry catalyst. It was also determined that oils with insufficient asphaltene content can be enriched with asphaltenes by adding asphaltene rich materials such as a vacuum residuum, as in this example, or other heavy oil containing asphaltenes. Accordingly, a hydrocarbonaceous oil slurry containing approximately 20 weight % catalyst solids and having an asphaltene content of at least 2.5 weight % (as measured; by a Hot Heptane Asphaltenes Test (Test Code 10810)) oil slurry was mixed with a solvent flocculant known to promote asphaltene precipitation at a mass ratio of 1:1 for 20 minutes in a heated mixing tank. Tests were conducted using two different solvents: a heptane solvent and a heavy naphtha solvent containing 35% paraffinic compounds. The temperature of the mixture was maintained at 65° C. for 30 minutes to ensure adequate time for asphaltene precipitation. This process successfully resulted in precipitation of an asphaltene flocculent comprising the asphaltenes and the catalyst solids. To verify the agglomeration of the solid material along with the precipitated asphaltenes, a sample of the flocculent was taken for microscopic examination which showed catalyst solids encapsulated in the precipitated asphaltene flocculent.

In the next step the oil, solvent, flocculant mixture was centrifuged in a first stage horizontal decanting centrifuge operating at 2500 to 3000 G (where G is gravity acceleration=9.8 m/sec$^2$). In the centrifuge, the solids consisting of catalyst encapsulated in precipitated asphaltenes and some of the liquids were discharged to a kiln feed tank as a paste in the centrifuge underflow, while most of the liquids were discharged in the centrifuge overflow. A volumetric analysis of samples from the overflow liquids indicated that 10% to 15% of the original solids content (catalyst and precipitated asphaltenes), as charged to the centrifuge, remained in the overflow liquids. These overflow liquids were collected in a separate, second heated tank, maintained at a temperature of 65° C. and diluted with additional flocculant solvent if the solids content exceeded weight concentration of about 5%.

Samples of overflow liquids were obtained and tested to determine the solids concentration. After being retained in the second heated tank for a time sufficient to achieve the desired degree of the asphaltene precipitation/flocculation (at least 30 minutes) the overflow liquids were discharged to a second stage centrifuge, which in this example was a vertical machine operating at about 9,000 G, which produced an underflow slurry with a solid material concentration of approximately 10 wt % to 20 wt % and an overflow hydrocarbonaceous liquid mixture containing less than about 2 wt % solid material.

The overflow liquid from the second stage centrifuge was then processed by conventional laboratory methods to separate the solvent, oil and remaining solid components. In commercial practice it is anticipated that recovery of solvent, oil and solids in this aspect of the invention will be by conventional condensers and stripping means known in the art.

In actual commercial practice and as depicted in FIG. 1, the underflow slurry from the second stage centrifuge will be mixed with the underflow slurry from the first stage centrifuge in the kiln feed tank. However, in this example the step of combining the first stage underflow slurry and the second stage underflow slurry was eliminated because it was not critical to establish the utility of this invention. Accordingly, the slurry mixture from the first stage centrifuge only was charged to a drying apparatus, which in this example was an indirect fired rotating kiln, and then dried by calcining in the kiln in an oxygen free atmosphere under a nitrogen blanket at a temperature between approximately 350° C. to 550° C. for a minimum residence time of approximately 45 minutes. This high temperature process caused the asphaltenes to fractionate resulting in the formation of a coked solid material and a hydrocarbon vapor stream.

In the calcining process, some solvent, a light fraction of the hydrocarbon liquid and the light ends of the fractionated asphaltenes evaporate and separate from the catalyst to form a vapor mixture, which also contains entrained solid material that was pulverized into a fine powder. This vaporous mixture of solvent, the light hydrocarbon fraction and entrained pulverized solids are passed from the kiln to a conventional system of condensers for solvent and solids recovery.

The remaining portion of the fractionated asphaltenes and the heavy fraction of the hydrocarbon liquids are calcined and thermally transformed into coke and encapsulate the ultrafine solid material producing, in this example, a coked catalyst.

The coked catalyst was removed from the kiln at a temperature of approximately 350° C. and, in this example, passed through an externally water chilled rotary cooler before being deposited to storage drums to hold for further processing and preparation for metals recovery processes. In actual commercial practice, is anticipated the coked catalyst will be removed from the kiln and then discharged immediately into in a water quench tank to fracture agglomerations of coked solid material and create an aqueous slurry. The aqueous slurry would then be transferred to a vertical grinding machine, diluted to about 50 weight % solids and ground to: a final size of approximately 16 μm. The coked material, as removed from the kiln in this example, was extremely fine and required limited power to be ground to a final size of about 16 μm for leaching purposes. Grinding of the coked material was carried out in an attrition grinding mill, in the presence of ceramic grinding balls, into which water was added to obtain a coked solid weight concentration ranging from about 40% to 55%. The mass ratio of coked solid material to ceramic grinding balls was approximately 1:1. In this example, the final product was a slurry of water, catalyst and coke having a particle diameter of about 16 μm. Additionally, partial leaching tests conducted during the grinding process, comprising the addition of an effective amount of ammonia, indicate that the initiation of metals recovery at this stage may be feasible.

What is claimed is:

1. A process for separating a particulate solid material from a hydrocarbon liquid comprising the following steps:

a) obtaining a bleed slurry comprising the hydrocarbon liquid and the solid material, b) cooling the bleed slurry, c) mixing the bleed slurry in a flocculant and to form a first mixture comprising the hydrocarbon liquid, a first solvent and a flocculent containing the solid material, d) separating the first mixture in a first centrifuge to form a second mixture and a third mixture, wherein the second mixture contains a low concentration of the flocculent and the third mixture contains a high concentration of the flocculent, e) separating the second mixture in at least one second centrifuge to form a fourth mixture comprising the first solvent and the hydrocarbon liquid and a fifth mixture containing a high concentration of the flocculent, f) combining the third mixture and the fifth mixture in a feed tank to form a final mixture comprising a high concentration of the flocculent, a low concentration of the first solvent and a low concentration of the hydrocarbon liquid, g) drying the final mixture in a drying device to form a hydrocarbon vapor mixture and a coked material wherein the hydrocarbon vapor comprises the solvent, a light fraction of the hydrocarbon liquid and entrained amounts of the solid material and wherein the coked material comprises the solid material and coke, h) recovering the hydrocarbon vapor mixture from the drying device and separating the entrained amounts of the solid material, the solvent and the light fraction of the hydrocarbon liquid by means of a system of one or more condensers and one or more oil recovery columns, i) recovering the coked solid material from the drying device, wherein the coked solid material is free of liquid hydrocarbons, j) thermally shocking the coked solid material in an aqueous quench tank to disagglomerate and form an aqueous slurry of the coked solid material.

2. The process of claim of the 1 wherein in the solid material comprises a catalyst.

3. The process of claim 2 wherein the catalyst comprises a major amount of a spent catalyst and a minor amount of an active catalyst.

4. The process of claim 2 wherein the catalyst is a slurry catalyst selected from the group consisting of Group VIB metal sulfide slurry catalysts and Group VIB metal sulfide slurry catalysts promoted with a Group VIII metal.

5. The process of claim 1 wherein the first solvent is an asphaltene flocculant and is selected from the group consisting of naphtha, heavy naphtha, light naptha, hexane and heptane.

6. The process of claim 5 wherein the first solvent is selected to promote the precipitation of the asphaltenes.

7. The process of claim 1 wherein the step c) further comprises adding the bleed slurry to one or more mixing tanks.

8. The process of claim 7 wherein the one or more mixing tanks are connected to a means for controlling the temperature of the bleed slurry.

9. The process of claim 1 wherein the first centrifuge is a horizontal decanter centrifuge and the second centrifuge is a vertical centrifuge.

10. The process of claim 1 wherein the flocculent of step c) is asphaltene.

11. The process of claim 1 wherein step c) further comprises mixing the bleed slurry and the first solvent for a period of time sufficient to allow the flocculent to form.

12. The process of claim 11 wherein the period of time is about 15 minutes to one hour.

13. The process of claim 11 wherein the period of time is about 30 minutes to one hour.

14. The process of claim 11 wherein the period of time is about 30 minutes.

15. The process of claim 1 wherein the first mixture of step c) comprises a solvent to bleed slurry mass ratio of about 3:1 to about 1:3.

16. The process of claim 15 wherein the first mixture of step c) comprises a solvent to bleed slurry mass ratio of about 2:1 to about 1:2.

17. The process of claim 16 wherein the bleed slurry to solvent mass ratio is about 1:1.

18. The process of claim 1 wherein the first mixture is maintained at a temperature between about 60° C. and 70° C.

19. The process of claim 17 wherein the first mixture is maintained at a temperature about 65° C.

20. The process of claim 1 wherein the drying device of step g) is selected from the group consisting of an indirect fired kiln, and indirect fired rotary kiln, an indirect fired dryer, an indirect fired rotary dryer, vacuum dryer and a flexicoker.

21. The process of claim 1 further comprising adding the solid material from step h) to the bleed slurry in step a).

22. The process of claim 1 further comprising grinding the aqueous slurry of the coked material in a suitable grinding machine to reduce the particle size of the coked solid material to between about 10 to 60 μm.

23. The process of claim 22 wherein the particle size of the coked solid material is reduced to between about 15 to 40 μm.

24. The process of claim 23 wherein the particle size of the coked solid material is reduced to about 15 to 20 μm.

25. The process of claim 22 further comprising adding an effective amount of a metals leaching chemical to the aqueous slurry of the coked solid material and maintaining the temperature there at about 98° C.

26. The process of claim 22 wherein the metals leaching chemical is ammonia.

27. The process of claim 1 wherein step g) further comprises calcining the final mixture in an atmosphere selected from the group consisting of an inert atmosphere and an atmosphere under vacuum.

28. The process of claim 27 wherein the inert atmosphere is a nitrogen atmosphere.

29. The process of claim 28 further comprising calcining the final mixture in a kiln at a temperature between about 350° C. to 550° C.

30. The process of claim 1 wherein the bleed slurry comprises at least 2.5 weight percent asphaltene.

31. The process of claim 1 wherein step c) further comprises adding a heavy hydrocarbon liquid to the bleed slurry in an amount sufficient to increase the asphaltene content of the bleed slurry to at least 2.5 weight percent.

32. The process of claim 31 wherein the heavy hydrocarbon liquid is selected from the group consisting of vacuum residuum, heavy crude oil, refractory heavy distillates, FCC decanted oils and lubricating oils.

33. The process of claim 1 wherein step a) further comprises obtaining the bleed slurry from a reactor vessel.

34. The process of claim 33 wherein the reactor vessel is selected from group consisting of hydrocracking reactors, hydroprocessing reactors, ebullated bed reactors, bubble column reactors and slurry reactors.

* * * * *